United States Patent [19]

Hughes

[11] 4,302,003

[45] Nov. 24, 1981

[54] WATER TOY

[76] Inventor: Thomas V. Hughes, 905 Hedlund Ct., San Jose, Calif. 95123

[21] Appl. No.: 66,287

[22] Filed: Aug. 13, 1979

[51] Int. Cl.[3] ..... A63G 19/00

[52] U.S. Cl. ..... 272/1 B; 46/92; 9/348

[58] Field of Search ..... 272/1 B, 1 D, 71; 280/1.208, 1.22; 46/91, 92, 87, 88, 89, 90, 11, 115, 116, 123, 152; 9/2 A, 11 A, 310 F, 311, 348, 5, 14, 301, 400; 222/78; 43/2, 3; D21/236, 237, 238, 239, 157, 158, 84; 215/1 C, 6; 206/315 R, 457, 822

[56] References Cited

U.S. PATENT DOCUMENTS

| | | | |
|---|---|---|---|
| D. 163,061 | 4/1951 | Meyer et al. | D21/237 X |
| 1,639,607 | 8/1927 | Henry | 272/1 B |
| 2,013,410 | 9/1935 | Howland | 272/1 B |
| 2,165,610 | 7/1939 | Boyle | 46/87 UX |
| 2,823,490 | 2/1958 | Greim | 46/11 |
| 3,098,317 | 7/1963 | Guzman | 46/87 |
| 3,183,002 | 5/1965 | Updaw | 46/92 X |
| 3,232,608 | 2/1966 | Vlacancich | 272/1 B |
| 3,303,602 | 2/1967 | Douglas | 46/11 |
| 3,334,899 | 8/1967 | Bosko et al. | 46/116 X |

FOREIGN PATENT DOCUMENTS

| | | | |
|---|---|---|---|
| 2625493 | 12/1977 | Fed. Rep. of Germany | 272/1 B |
| 265050 | 2/1927 | United Kingdom | 272/1 B |
| 324076 | 1/1930 | United Kingdom | 272/1 B |

*Primary Examiner*—Richard C. Pinkham
*Assistant Examiner*—Arnold W. Kramer
*Attorney, Agent, or Firm*—Paul L. Hickman

[57] ABSTRACT

A water toy is disclosed including an elongated body portion, a head portion attached to one end of the body portion, and a tail portion attached to the other end of the body portion. At least the tail portion, and preferably the body and head portions, is hollowed to create a sealable chamber which can be filled with and emptied of water through a fill hole. A user straddles the body portion, settles back against a contoured surface of the tail portion and "rides" the water toy along the surface of a swimming pool, lake, etc. The hollowed portions allow the weight and weight distribution of the water toy to be varied to modify the character of the ride and to accommodate riders of different sizes and weights.

6 Claims, 3 Drawing Figures

WATER TOY

BACKGROUND OF THE INVENTION

1. Field of the Invention

This invention relates generally to toys, and more particularly to water toys that can be ridden by a person along the surface, or just below the surface, of a large body of water, such as a swimming pool or lake.

2. Description of the Prior Art

Water toys of various types have been in common usage for many years at pools, lakes and beaches. The most common type of water toys include the mattress shaped floats, the toroidial or donut shaped floats, and the floats that are shaped to resemble an animal. Some problems encountered with such floats include that they are intrinsically unstable (unless they are made very large) and that they are not very versatile in use.

In U.S. Pat. No. 4,073,397, E. E. Snodgrass describes a duck shaped container which, when emptied, can be used as a duck decoy or as a toy. Snodgrass' device is of the float type described above, and is subject to the previously described disadvantages.

C. H. Bramson, in U.S. Pat. No. 3,254,441, teaches a water toy made from a flexible, waterproof material formed into a long, animal shaped tube having an open tail end and a closed forward end. When the tube is squeezed, water is jetted out of the open tail end to propel the water toy forwardly. While Bramson's invention appears to be functional for its desired purpose, it again appears that it is not very versatile in use due to its single preferred mode of operation.

D. A. Pagani, in British Pat. No. 1,451,898, discloses a toy comprising a hollow, egg shaped figure provided with a weighted bottom to provide stability. Pagani's invention does not appear to be well suited for use as a riding toy, either in the water or on dry land.

In short, the prior art does not appear to have addressed the need for a Water Toy that is of an intrinsically stable design, and one which has adjustable floating characteristics to add versatility to the toy's uses.

SUMMARY OF THE INVENTION

An object of this invention is to provide a Water Toy which can have its floating characteristics selectively altered to accommodate persons of varying sizes and weights.

It is another object of this invention to provide a Water Toy that can have its floating characteristics selectively atlered to vary the character of the toy's ride and thus increase the versatility of the toy.

Yet another object of this invention is to provide a Water Toy in accordance with the above mentioned objects which further is configured to resemble an animal.

Yet a further object of this invention is to provide a Water Toy which comfortably seats a single user, and one which can be "ridden" along the surface, or, perhaps, just under the surface of a swimming pool, lake, etc.

Briefly, the invention comprises an elongated body portion, a head portion attached to one end of the body portion, and a tail portion attached to the other end of the body portion. Preferably, each of the portions are hollowed to create individually sealable chambers that can be selectively filled with water through an associated fill hole. By filling the chambers with water, the floating characteristics of the toy can be varied to accommodate different users or to vary the type of ride experienced by a single user.

Preferably, the head portion of the Water Toy is configured to resemble the head of an aqueous or semi-aqueous animal, such as a shark, hippopotamus or duck. The tail portion of the Water Toy is contoured to comfortably seat a user's buttocks and groin region, and the body portion of the Water Toy is usually provided with a handle and a plurality of chin rests.

An advantage of this invention is that the individually fillable chambers allow a user to adjust the floating characteristics of the Water Toy, thus increasing the number of ways that the Water Toy can be used.

Another advantage of this invention is that its design allows the Water Toy to be produced in a very economical manner, such as by plastic injection molding, and yet be rugged and longlasting.

These and other objects and advantages of the present invention will no doubt become apparent upon a reading of the following detailed description as accompanied by the several figures of the drawing.

DETAILED DESCRIPTION OF THE PREFERRED EMBODIMENT

Figure 1:
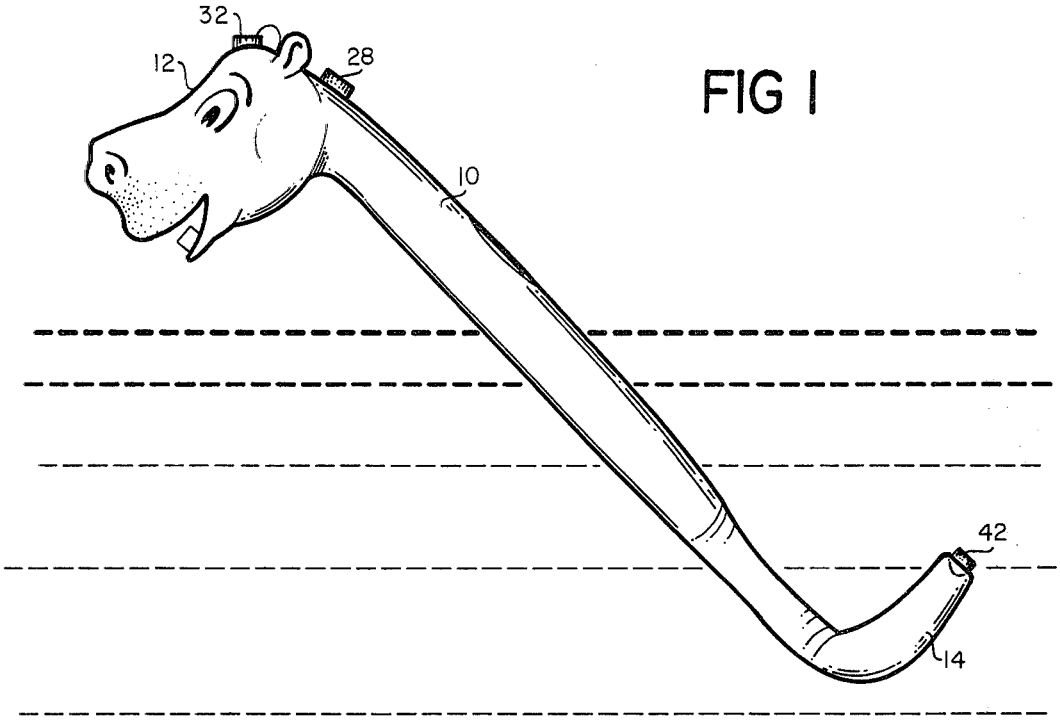
FIG. 1 is a side elevational view of a Water Toy in accordance with the present invention. The Water Toy is shown partially submerged in a large body of water, such as a swimming pool.
Figure 2:
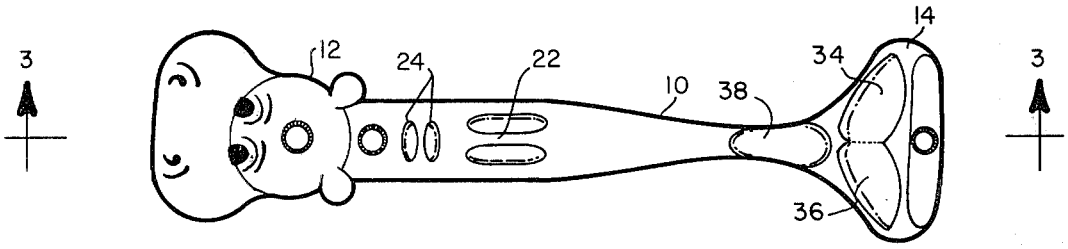
FIG. 2 is a top plan view of the Water Toy shown in FIG. 1. Particularly visible in this figure are the user accommodating depressions of the toy, as well as the recessed handhold and the fill-hole caps.
Figure 3:
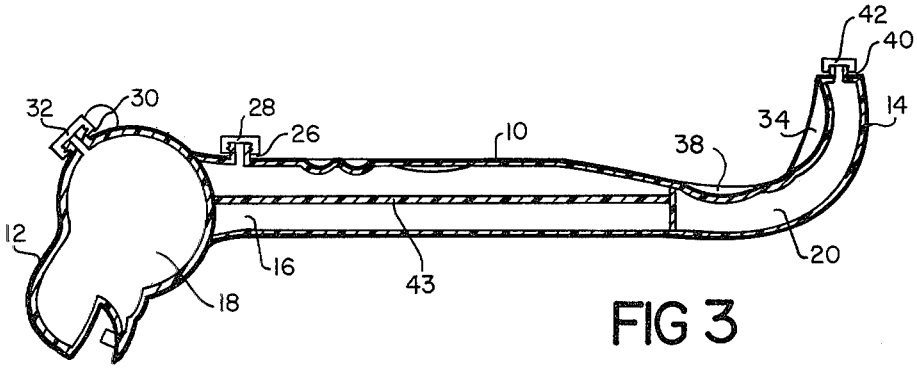
FIG. 3 is a cross sectional view taken along line 3—3 of FIG. 2. The hollow construction of the toy can be easily seen in this figure, as well as a previously unseen internal shaft which strengthens the structure of the toy. The shaft may be optional, depending upon the intrinsic strength of various portions of the toy and of their interconnections.

Referring to FIGS. 1, 2 and 3 in general, a Water Toy in accordance with the present invention is shown to include an elongated body portion 10, a head portion 12 attached to one end of the body portion, and a tail portion 14 attached to the other end of the body portion. As best seen in the cross sectional view of FIG. 3, the three portions of the Water Toy are substantially hollow to form independently fillable chambers 16, 18 and 20, respectively.

Body portion 10 is substantially cylindrically tube shaped, although it does taper where it is connected to tail portion 14 and flare slightly where it is connected to head portion 12. The body portion is provided with a handle means 22 which is formed flush with the upper surface of the body portion as shown. The body portion also may or may not be provided with one or more depressions which forms chin rests 24.

Chamber 16 can be filled with or emptied of water through a water fill hole 26 when a fill hole cap 28 is removed. By varying the amount of water within chamber 16 the buoyancy of body portion 10 is likewise varied. The consequence of this capability to vary the buoyancy of a part of the Water Toy will be discussed subsequently.

Head portion 12 is preferably configured to resemble the head of a water related animal. While this preferred embodiment of the present invention has a head portion configured to resemble a hippopatamus' head, other preferred embodiments have head portions resembling ducks, sharks, etc. Head portion 12 is also provided with a water fill hole 30 and an associated fill hole cap 32.

Tail portion 14 is a generally scoop shaped structure designed to provide a comfortable seat for a person straddling the body portion of the Water Toy. A pair of depressions 34 and 36 cup the buttocks of a user, and a concavity 38 is provided to accommodate the groin region of a user. A water fill hole 40 is provided for the filling and emptying of chamber 20, and a cap 42 is provided to close fill hole 40.

Also seen in FIG. 3 is an optional, but usually desirable strengthening shaft 43. The shaft, which is usually wood doweling, is disposed within chamber 16 and couples the head portion to the tail portion.

To use the Water Toy, a user first decides how he or she would like the toy to ride. For instance, if the user would like the Water Toy to ride substantially flat along the surface of the water, the tail portion should be more or less empty of water, while the body portion and the head portion should be partially filled to provide some degree of stability. If the user wants the Water Toy to be submerged below the surface of the water, all three chambers 16, 18 and 20 should be flooded with water. Alternatively, if a user wants to ride the Water Toy in a semi-upright position, as shown in FIG. 1, the tail portion of the toy should be filled, the body portion partially filled, and the head portion practically emptied of water. Thus, by varying the amount of water within the three chambers of the Water Toy the characteristics of the user's ride can be drastically altered.

Once the type of ride is decided upon, the user can then adjust the Water Toy for his or her own weight and size. For instance, a heavier user would probably want more water in the head and body portions, and a lighter user would probably want more water in the tail portion. Generally speaking, for any particular type of ride, a heavier user would probably have less water in the chambers than a lighter user, although the proportions of the water from chamber-to-chamber might be the same. Usually some water is present within at least one chamber to enhance the stability of the toy.

Finally, a user straddles the body portion with his or her legs and settles back into the depressions 34 and 36 of the tail portion. Concavity 38 prevents possibly uncomfortable pressure on the groin region of a male user. The user can then grasp handle means 22 to jockey the Water Toy about, or may simply balance on the toy and ride it with both hands free. In fact, it is a tribute to the toy's stability that such free hand riding is possible. By a combination of rocking, kicking, paddling and weight shifting the Water Toy can be propelled in any direction.

While this invention has been described with reference to a single preferred embodiment, it is contemplated that those skilled in the art will realize various modifications thereof upon a reading of the preceding description. For instance, it has been found that the head and body portions of the Water Toy can be permanently ballasted, with the result that fill holes 26 and 30 can be omitted. In such an embodiment, the chamber 20 would adjust the buoyancy of the Water Toy in a slightly less efficient but still very versatile manner.

Furthermore, there are many types of materials suitable for the construction of the Water Toy of the present invention, as well as many different manufacturing techniques. One such combination of material and technique would be to construct the Water Toy from an injection molded solid or foamed thermoplastic material.

Lastly, modifications such as the locations of the fill holes are within the scope of this invention. For example, some embodiments of this invention provide fill holes along a bottom surface of the toy to make it easier to fill.

It is therefore intended that the following appended claims be interpreted as including all such modifications as fall within the true spirit and scope of the present invention.

I claim:

1. A water toy comprising an elongated, hollow, rigid body having a fixed internal volume, said body being constructed of a non-expansile thermoplastic material and having a head section provided with a first fill hole, a middle section provided with a second fill hole, and a tail section provided with a third fill hole, where said head section is configured to resemble the head of an animal, a first impermeable barrier attached within said body, a second impermeable barrier attached within said body and spaced from said first impermeable barrier, said first barrier and said second barrier dividing said fixed internal volume into three independent chambers including a head section chamber, a middle section chamber, and a tall section chamber, a first closure means associated with said first fill hole for selectively sealing and unsealing said head section chamber, a second closure means associated with said second fill hole for selectively sealing and unsealing said middle section chamber, and a third closure means associated with said third fill hole for selectively sealing and unsealing said tail section chamber, whereby each of said three chambers can be individually filled with and depleted of water through said fill holes so that when said water toy is disposed within a large body of water the nature of the ride may be modified.

2. A water toy as claimed in claim 1 wherein said tail section is provided with an external surface configuration adapted to support the buttocks of a person straddling said middle section.

3. A water toy as claimed in claim 2 wherein said middle section is provided with a handle means.

4. A water toy as claimed in claim 3 further comprising an eleongated shaft extending through said middle section chamber and attached at a first end to said first barrier and attached at a second end to said second barrier.

5. A water toy as claimed in claim 4 wherein said middle section is provided with a concavity proximate said tail section for accomodating the groin region of said person.

6. A water toy as claimed in claim 5 wherein said middle section is provided with a plurality of concavities proximate said head section which can serve as chin rests for said person.

* * * * *